US006006398A

United States Patent [19]

Larson et al.

[11] Patent Number: 6,006,398

[45] Date of Patent: Dec. 28, 1999

[54] SAFETY SHUTOFF SYSTEM FOR STEAM CLEANERS AND COMBINATION STEAM AND WATER CLEANERS

[75] Inventors: Arden L. Larson, Sioux Falls; Glen Lawrenson, Beresford, both of S. Dak.

[73] Assignee: Sioux Steam Cleaner Corporation, Beresford, S. Dak.

[21] Appl. No.: 09/106,419

[22] Filed: Jun. 29, 1998

[51] Int. Cl.[6] ..... B05B 1/24

[52] U.S. Cl. ..... 15/314; 15/319; 137/341; 137/563; 239/127; 239/135

[58] Field of Search ..... 15/302, 304, 314, 15/319; 137/341, 563, 487.5, 893, 895; 239/127, 135

[56] References Cited

U.S. PATENT DOCUMENTS

| | | | |
|---|---|---|---|
| D. 287,653 | 1/1987 | Nelson . | |
| 3,355,324 | 11/1967 | Catzen . | |
| 3,438,580 | 4/1969 | Siebring | 15/302 |
| 3,490,482 | 1/1970 | Sachs et al. . | |
| 3,522,909 | 8/1970 | Arant | 239/127 |
| 3,595,268 | 7/1971 | Archer . | |
| 3,669,297 | 6/1972 | Willinger . | |
| 3,773,065 | 11/1973 | Mattox . | |
| 3,814,321 | 6/1974 | Mulholland et al. . | |
| 4,217,924 | 8/1980 | Finger . | |
| 4,321,219 | 3/1982 | Barker . | |
| 4,368,757 | 1/1983 | Finger . | |
| 4,738,541 | 4/1988 | Weber . | |
| 5,259,556 | 11/1993 | Paige et al. . | |
| 5,678,593 | 10/1997 | Lockhart . | |

FOREIGN PATENT DOCUMENTS

| | | | |
|---|---|---|---|
| 2053741 | 2/1981 | United Kingdom | 239/135 |
| WO 93/04623 | 3/1993 | WIPO . | |
| WO 94/24920 | 11/1994 | WIPO . | |

*Primary Examiner*—Terrence R. Till
*Attorney, Agent, or Firm*—Kaardal & Associates, PC

[57] ABSTRACT

A safety shutoff system for steam and combination steam and water cleaners for permitting safe shutoff at the hand held spray gun thereof. The system includes a fluid reservoir connected to a first valve by a first conduit having a first pump for pumping fluid from the reservoir towards the first valve. A by-pass conduit connects the first valve to the fluid reservoir. An outlet conduit is connected to the first valve. The first valve controls fluid flow between the first conduit and the outlet conduit. The first valve blocks fluid flow from the first conduit into the outlet conduit upon detection of a pressure in the outlet conduit greater than a predetermined pressure such that fluid flowing from the first conduit passes into the by-pass conduit. The outlet conduit has a spray gun with a shutoff valve and a fluid heater between the first valve and the shutoff valve. A first switch detects the rate of fluid flow through the outlet conduit, and triggers deactivation of the heater when the rate of fluid flow through the outlet conduit between the first valve and the heater is less than a predetermined rate. A second switch detects the temperature of fluid in the outlet conduit between the heater and the shutoff valve, and triggers deactivation of the heater when the temperature of the fluid in the outlet conduit between the heater and the shutoff valve exceeds a predetermined temperature.

14 Claims, 2 Drawing Sheets

SAFETY SHUTOFF SYSTEM FOR STEAM CLEANERS AND COMBINATION STEAM AND WATER CLEANERS

BACKGROUND OF THE INVENTION

1. Field of the Invention

The present invention relates to shutoff systems for steam cleaners and more particularly pertains to a new safety shutoff system for steam cleaners and combination steam and water cleaners for permitting safe shutoff at the hand held spray gun of the steam or combination cleaner.

2. Description of the Prior Art

Known prior art systems pertaining to pressurized cleaners include U.S. Pat. No. 5,259,556; U.S. Pat. No. 4,368,757; U.S. Pat. No. 4,217,924; U.S. Pat. No. 3,814,321; U.S. Pat. No. 4,321,219; U.S. Pat. No. 3,595,268; U. S. Pat. No. 3,669,297; U.S. Pat. No. 4,738,541; U.S. Pat. No. 3,773,065; U.S. Pat. No. 5,678,593; U.S. Pat. No. 3,490,482; U.S. Pat. No. 3,355,324; PCT Patent No. WO 93/04623 (Inventor: Held); PCT Patent No. WO 94/24920 (Inventor: Sham); and U.S. Pat. No. Des. 287,653.

While these devices fulfill their respective, particular objectives and requirements, the aforementioned patents do not disclose a new safety shutoff system for steam cleaners and combination steam and water cleaners. Safety concerns require that pressurized fluid cleaning devices have a means for stopping fluid flow from the outlet of the cleaning device that is located at (or very near) the pressurized fluid outlet (which is typically remote from the main body of the steam cleaning device). The use of shutoff systems located proximate to the fluid outlet of heated water cleaners is known in the prior art. However, using only a conventional shutoff valve found on a conventional heated water cleaning device has been avoided on a steam cleaning device because of significant safety concerns. Simply blocking steam flow at the outlet of the steam cleaning device, as is done in conventional heated water cleaning devices can cause a build up of internal water and steam temperatures and pressures in the steam cleaning device greatly increases the risk of an explosion of the steam cleaning device from the build up.

A safety system that immediately shuts off the fluid heater is also undesirable because this interruption can cause a user to have to wait for a period of time after the interruption before sufficient amounts of steam and heated water are available again at the fluid outlet.

Because of the inherent dangers and drawbacks of employing a shutoff valve at the fluid outlet of a steam cleaning device, known steam cleaning devices have only employed shutoffs at the main body of the steam cleaning device that shut off the pressuring pump and the fluid heater. The danger of having a shutoff remote from the fluid outlet has been considered lesser than the explosion hazard.

In these respects, the safety shutoff system for steam cleaners and combination steam and water cleaners according to the present invention substantially departs from the conventional concepts and designs of the prior art, and in so doing provides an apparatus primarily developed for the purpose of permitting safe shutoff at the hand held spray gun of the steam or combination cleaner.

SUMMARY OF THE INVENTION

In view of the foregoing disadvantages inherent in the known types of shutoff systems for steam cleaners now present in the prior art, the present invention provides a new safety shutoff system for steam cleaners and combination steam and water cleaners construction wherein the same can be utilized for permitting safe shutoff at the hand held spray gun of the steam or combination cleaner.

The general purpose of the present invention, which will be described subsequently in greater detail, is to provide a new safety shutoff system for steam cleaners and combination steam and water cleaners apparatus and method which has many of the advantages of the shutoff systems for steam cleaners mentioned heretofore and many novel features that result in a new safety shutoff system for steam cleaners and combination steam and water cleaners which is not anticipated, rendered obvious, suggested, or even implied by any of the prior art shutoff systems for steam cleaners, either alone or in any combination thereof.

To attain this, the present invention generally comprises a fluid reservoir for holding a volume of fluid fluidly connected to a first valve by a first conduit. The first conduit has a first pump for pumping fluid through the first conduit from the fluid reservoir towards the first valve. A by-pass conduit also fluidly connects the first valve to the fluid reservoir. An outlet conduit is fluidly connected to the first valve. The first valve permits selective passage of fluid from the first conduit into the outlet conduit when open. The first valve closes passage of fluid from the first conduit into the outlet conduit when the first valve detects a pressure in the outlet conduit greater than a predetermined pressure such that fluid flowing from the first conduit passes into the by-pass conduit. The outlet conduit has an open end with a spray gun positioned adjacent the open end of the outlet conduit. The spray gun has a shutoff valve which is designed for selective opening and closing of the outlet conduit. The outlet conduit has a heater for heating fluid passing through the outlet conduit. The heater is positioned between the first valve and the shutoff valve. A first switch is located between the first valve and the heater and is operatively connected to the heater. The first switch is designed for selectively activating the heater to provide heat. The first switch detects the rate of fluid flow through the outlet conduit. The first switch triggers deactivation of the heater when the rate of fluid flow through the outlet conduit between the first valve and the heater is less than a predetermined rate of fluid flow. A second switch located between the heater and the shutoff valve is operatively connected to the heater. The second switch detects the temperature of fluid in the outlet conduit between the heater and the shutoff valve. The second switch triggers deactivation of the heater when the temperature of the fluid in the outlet conduit between the heater and the shutoff valve is greater than a predetermined temperature.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new safety shutoff system for steam cleaners and combination steam and water cleaners apparatus and method which has many of the advantages of the shutoff systems for steam cleaners mentioned heretofore and many novel features that result in a new safety shutoff system for steam cleaners and combination steam and water cleaners which is not anticipated, rendered obvious, suggested, or even implied by any of the prior art shutoff systems for steam cleaners, either alone or in any combination thereof.

It is another object of the present invention to provide a new safety shutoff system for steam cleaners and combination steam and water cleaners which may be easily and efficiently manufactured and marketed.

It is a further object of the present invention to provide a new safety shutoff system for steam cleaners and combination steam and water cleaners which is of a durable and reliable construction.

An even further object of the present invention is to provide a new safety shutoff system for steam cleaners and combination steam and water cleaners which is susceptible of a low cost of manufacture with regard to both materials and labor, and which accordingly is then susceptible of low prices of sale to the consuming public, thereby making such safety shutoff system for steam cleaners and combination steam and water cleaners economically available to the buying public.

Still yet another object of the present invention is to provide a new safety shutoff system for steam cleaners and combination steam and water cleaners which provides in the apparatuses and methods of the prior art some of the advantages thereof, while simultaneously overcoming some of the disadvantages normally associated therewith.

Still another object of the present invention is to provide a new safety shutoff system for steam cleaners and combination steam and water cleaners for permitting safe shutoff at the hand held spray gun of the steam or combination cleaner that helps prevent build ups of excessive pressures and temperatures.

Yet another object of the present invention is to provide a new safety shutoff system for steam cleaners and combination steam and water cleaners which includes a fluid reservoir for holding a volume of fluid fluidly connected to a first valve by a first conduit. The first conduit has a first pump for pumping fluid through the first conduit from the fluid reservoir towards the first valve. A bypass conduit also fluidly connects the first valve to the fluid reservoir. An outlet conduit is fluidly connected to the first valve. The first valve permits selective passage of fluid from the first conduit into the outlet conduit when open. The first valve closes passage of fluid from the first conduit into the outlet conduit when the first valve detects a pressure in the outlet conduit greater than a predetermined pressure such that fluid flowing from the first conduit passes into the by-pass conduit. The outlet conduit has an open end with a spray gun positioned adjacent the open end of the outlet conduit. The spray gun has a shutoff valve which is designed for selective opening and closing of the outlet conduit. The outlet conduit has a heater for heating fluid passing through the outlet conduit. The heater is positioned between the first valve and the shutoff valve. A first switch is located between the first valve and the heater and is operatively connected to the heater. The first switch is designed for selectively activating the heater to provide heat. The first switch detects the rate of fluid flow through the outlet conduit. The first switch triggers deactivation of the heater when the rate of fluid flow through the outlet conduit between the first valve and the heater is less than a predetermined rate of fluid flow. A second switch located between the heater and the shutoff valve is operatively connected to the heater. The second switch detects the temperature of fluid in the outlet conduit between the heater and the shutoff valve. The second switch triggers deactivation of the heater when the temperature of the fluid in the outlet conduit between the heater and the shutoff valve is greater than a predetermined temperature.

Still yet another object of the present invention is to provide a new safety shutoff system for steam cleaners and combination steam and water cleaners that can provide a safety "deadman" shutoff control that requires a positive hand pressure to release fluid from the fluid outlet and thereby shuts off fluid flow from the outlet when the user drops or otherwise loses control of the spray gun.

Still another object of the present invention is to provide a new safety shutoff system for steam cleaners and combination steam and water cleaners allows shut off of the flow of steam and water during emergency situations when the shutoff on the main body of the steam cleaner cannot be reached by the user.

Still yet another object of the present invention is to provide a new safety shutoff system for steam cleaners and combination steam and water cleaners that helps reduce fuel consumption by shutting off the heater when its operation is not needed for heated fluid (e.g., when the remote shutoff valve has been closed).

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
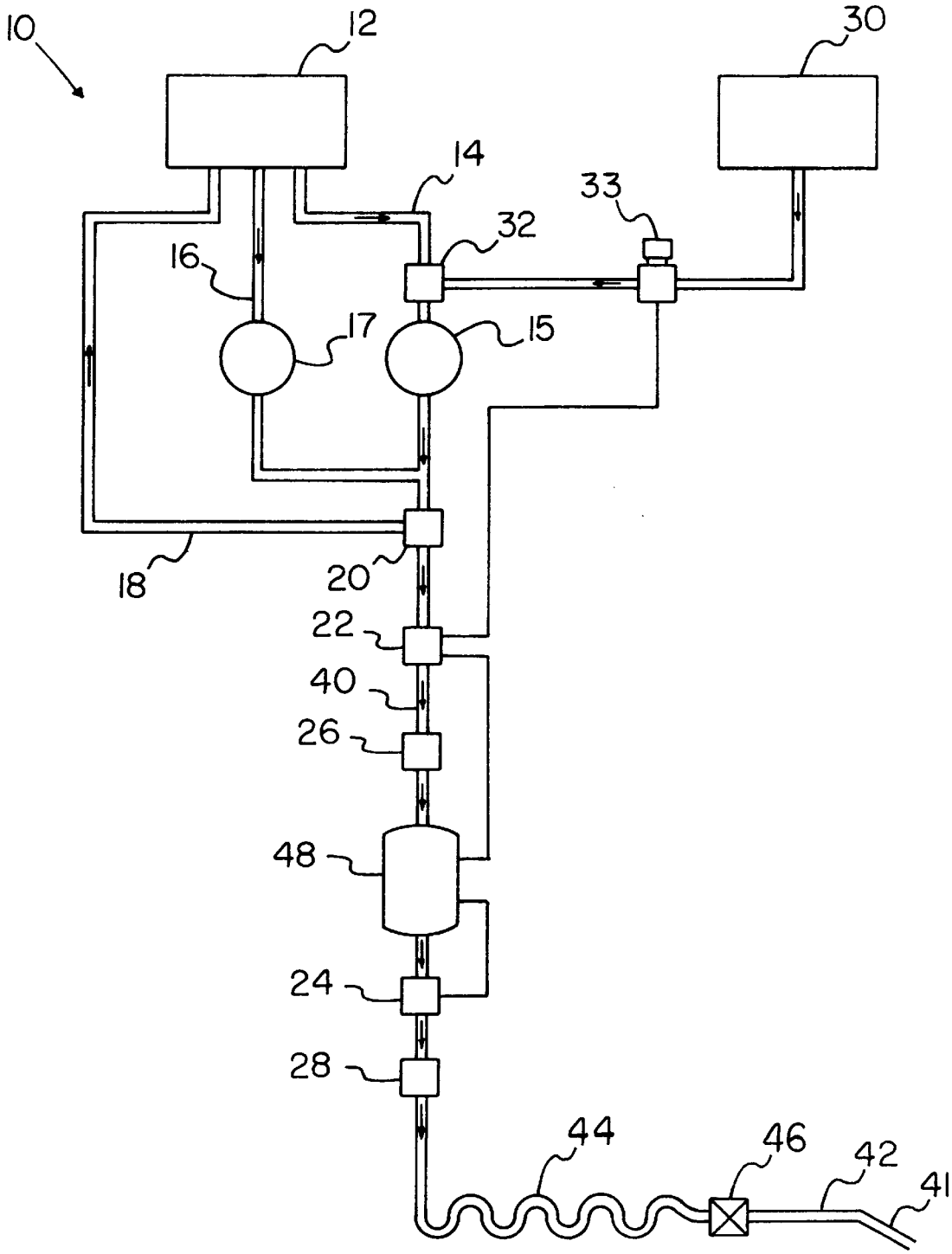
FIG. 1 is a schematic illustration of a new safety shutoff system for a combination steam and water cleaner according to the present invention.
Figure 2:
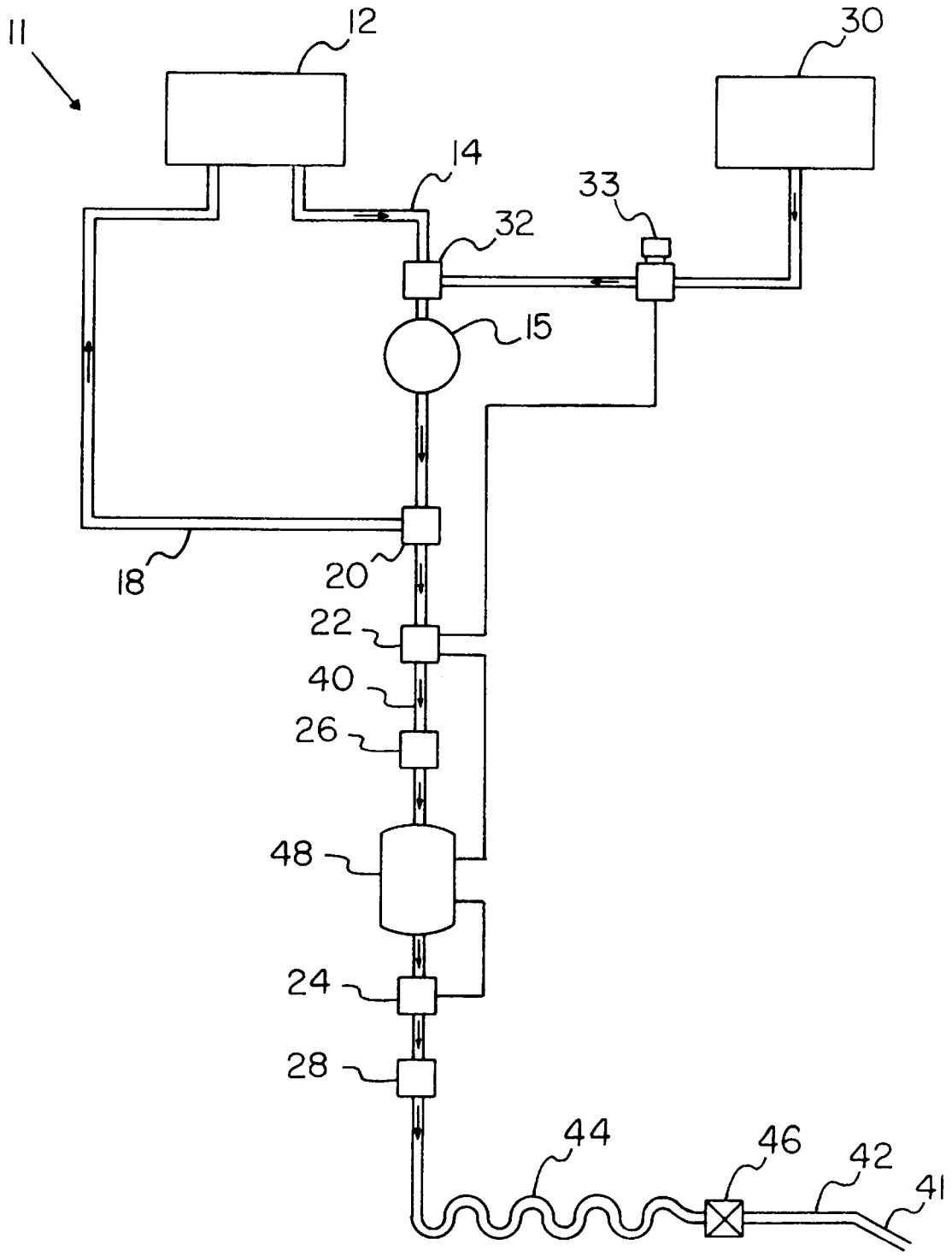
FIG. 2 is a schematic illustration of a steam cleaner having the safety shutoff system.

As best illustrated in FIGS. 1 through 2, the safety shutoff system for steam cleaners and combination steam and water cleaners generally comprises a fluid reservoir 12 for holding a volume of fluid fluidly connected to a first valve 20 by a first conduit 14. The first conduit 14 has a first pump 15 for pumping fluid through the first conduit 14 from the fluid reservoir 12 towards the first valve 20. A by-pass conduit 18 also fluidly connects the first valve 20 to the fluid reservoir 12. An outlet conduit 40 is fluidly connected to the first valve 20. The first valve 20 permits selective passage of fluid from the first conduit 14 into the outlet conduit 40 when open. The first valve 20 closes passage of fluid from the first conduit 14 into the outlet conduit 40 when the first valve 20 detects a pressure in the outlet conduit 40 greater than a predetermined pressure such that fluid flowing from the first conduit 14 passes into the by-pass conduit 18. The outlet conduit 40 has an open end with a spray gun 42 positioned adjacent the open end of the outlet conduit 40. The spray gun 42 has a shutoff valve 46 which is designed for selective opening and closing of the outlet conduit 40. The outlet conduit 40 has a heater 48 for heating fluid passing through the outlet conduit 40. The heater 48 is positioned between the first valve 20 and the shutoff valve 46. A first switch 22 is located between the first valve 20 and the heater 48 and is operatively connected to the heater 48. The first switch 22 is designed for selectively activating the heater 48 to provide heat. The first switch 22 detects the rate of fluid flow through the outlet conduit 40. The first switch 22 triggers deactivation of the heater 48 when the rate of fluid flow through the outlet conduit 40 between the first valve 20 and the heater 48 is less than a predetermined rate of fluid flow. A second switch 24 located between the heater 48 and the shutoff valve 46 is operatively connected to the heater 48. The second switch 24 detects the temperature of fluid in the outlet conduit 40 between the heater 48 and the shutoff valve 46. The second switch 24 triggers deactivation of the heater 48 when the temperature of the fluid in the outlet conduit 40 between the heater 48 and the shutoff valve 46 is greater than a predetermined temperature.

In closer detail, the safety shutoff system is designed for steam cleaning devices, including combination steam and heated water cleaners 10, as illustrated in FIG. 1 and only steam cleaners 11, as illustrated in FIG. 2. The fluid reservoir 12 is designed for holding a volume of fluid such as water. The first conduit 14 fluidly connects the fluid reservoir 12 to the first valve 20. The first conduit 14 has a first pump 15 for pumping fluid through the first conduit 14 from the fluid reservoir 12 towards the first valve 20. With reference to FIG. 1, in the combination cleaner 10, a second conduit 16 also fluidly connects the fluid reservoir 12 to the first valve 20. The second conduit 16 also has a second pump 17 for pumping fluid through the second conduit 16 from the fluid reservoir 12 towards the first valve 20. In both cleaners 10,11, the by-pass conduit 18 fluidly connects the first valve 20 to the fluid reservoir 12 to permit flow of fluid from the first valve 20 towards the fluid reservoir 12. The outlet conduit 40 is also fluidly connected to the first valve 20.

The first valve 20 permits selective passage of fluid from the first and second conduits 14,16 into the outlet conduit 40 when open. The first valve 20 closes passage of fluid from the first and second conduits 14,16 into the outlet conduit 40 when the first valve 20 detects a pressure in the outlet conduit 40 greater than a predetermined pressure such that fluid flowing from the first and second conduits 14,16 passes into the by-pass conduit 18. The first valve 20 is preferably biased towards the open position to permit flow from the first and second conduits 14,16 into the outlet conduit 40. Ideally, the first valve 20 comprises an unloader valve, such as, for example a trapped pressure multi-port unloader valve of the type sold by General Pump, Inc., Mendota Heights, Minn. 55120.

Preferably, the cleaners 10,11 include an additive reservoir 30 for holding an additive such as a detergent. The additive reservoir 30 is in fluid communication with the first conduit 14, preferably between the fluid reservoir 12 and the first pump 15. An additive delivery system is provided for introducing an additive from the additive reservoir 30 into the first conduit 14 between the fluid reservoir 12 and the first pump 15. Preferably, the additive delivery system comprises a siphon injector 32 and a second valve 33. The second valve 33 is interposed between the siphon injector 32 and the additive reservoir 30. Ideally, the second valve 33 comprises a solenoid valve. Optionally, the additive delivery system may comprise a chemical pump (instead of a siphon injector and solenoid valve) for pumping an additive from the additive reservoir 30 to the first conduit 14.

The outlet conduit 40 has an open end 41 distal the first valve 20 for permitting the passing of fluid such as steam and heated water from the outlet conduit 40 to the outside. The outlet conduit 40 has a hand held spray gun 42 at the open end of the outlet conduit 40. The outlet conduit 40 also preferably includes a length of flexible hose 44 located adjacent the hand held spray gun 42. The hand held spray gun 42 has a shutoff valve 46. The shutoff valve 46 is designed for permitting a user at or holding the hand held spray gun 42 to selectively open and close the outlet conduit 40. Preferably, the shutoff valve 46 has an actuator on the spray gun and remote from the main power controls of the cleaner for permitting a user to selectively open and close the shutoff valve 46. Ideally, shutoff valve 46 is a deadman's valve such that the shutoff valve 46 is biased towards closing the outlet conduit 40 until a user activates the actuator.

The outlet conduit 40 has a heater 48 for heating fluid passing through the outlet conduit 40. The heater 48 is positioned between the first valve 20 and the length of flexible hose 44 of the outlet conduit 40. The outlet conduit 40 has a first switch 22, or flow rate detection switch, located between the first valve 20 and the heater 48 and which is also operatively connected to the heater 48. The first switch 22 is designed for detecting the rate of fluid flow through the outlet conduit 40 and preferably designed for selectively activating the heater 48 to provide heat when activated. The first switch 22 triggers deactivation of the heater 48 when the rate of fluid flow through the outlet conduit 40 between the first valve 20 and the heater 48 is less than a predetermined rate of fluid flow. Ideally, the first switch 22 is, for example, of the type sold by Dwyer Instruments, Inc., Michigan City, Ind. 46361 under the registered trademark Flotect, including Model V6 Mini-size flow switches. In the preferred embodiment, the second valve of the additive delivery system is operatively connected to the first switch 22 such that the first switch 22 triggers closure of the second valve 33 when the first switch 22 triggers deactivation of the heater 48 that is when the first switch 22 detects a rate of fluid flow less than the predetermined rate of fluid flow.

The outlet conduit 40 has a second switch 24, or temperature detection switch, which is located between the heater 48 and the shutoff valve 46 and operatively connected to the heater 48. The second switch 24 detects the temperature of fluid in the outlet conduit 40 between the heater 48 and the shutoff valve 46. The second switch 24 triggers deactivation of the heater 48 when the temperature of the fluid in the outlet conduit 40 between the heater 48 and the shutoff valve 46 is greater than a predetermined temperature. The heater 48 is activated to provide heat when the first switch 22 detects the rate of fluid flow through the outlet conduit 40 greater than the predetermined rate of fluid flow and when the second switch 24 detects the temperature of fluid between the heater 48 and shutoff valve 46 is less than the predetermined temperature.

The outlet conduit 40 preferably has a third valve 28, or pressure detection valve, located between the heater 48 and the shutoff valve 46. The third valve 28 is designed to open to release fluid and steam to reduce pressure in the outlet conduit 40 between the heater 48 and the steam shutoff valve 46 when pressure in the outlet valve is greater than a predetermined pressure. Ideally, the third valve 28 comprises a pressure relief valve of the type sold, for example, as the R5200 series Adjustable Right Angle Relief Valves by Circle Seal Controls, Inc., Corona, Calif., 91718. The outlet conduit 40 has a third switch 26, or pressure detective switch, located between the first valve 20 and the heater 48. The third switch 26 is designed for cutting off power from a power supply supplying power to the cleaning device 10,11 such that power to the first and second pumps 15,17 and the heater 48 is cutoff when pressure in the outlet conduit 40 is greater than a predetermined pressure. Ideally, the third switch 26 comprises a pressure switch.

In use, water is drawn from the fluid reservoir 12 through the first and second conduits 14,16 by the pumps 15,17. An additive is drawn from the additive reservoir 30 through the siphon injector 32 into the suction side of the first conduit 14 between the fluid reservoir 12 and the first pump 15. The flow of the additive is shut-off with the means of the second valve 33 (preferably a solenoid valve) of the additive delivery system. From the pumps 15,17 the water passes through the first valve 20 (preferably an unloader valve) which controls the discharge pressure and bypasses the flow back to the fluid reservoir 12 through the by-pass conduit 18 when the shutoff valve 46 on the spray gun 42 is closed.

From the first valve 20 the water passes through the first switch 22 which is preferably a normally open switch. The first switch 22 closes when sufficient flow is available and provides power to the heater 48. When the first switch 22 and the second switch 22 are all in the closed position, the heater is activated to provide heat. The open end 41 of the outlet conduit 40 and the pumps 15,17 pressures determine the flow rate through the heater 48. Once the heat temperature provided by the heater 48 has stabilized to a steady state condition, the outlet water temperature will remain constant.

If for some reason the flow is reduced or obstructed in the outlet conduit 40, the temperature of the water will rise to temperature that is limited by the second switch 24. Once the set temperature of the second switch 24 is reached the switch 24 deactivates the heater 48 so that the discharge water temperature drops back to an automatic reset temperature. At this point the heater 48 is re-powered to heat the water flow through the outlet conduit 40.

The additive flow is started is started by opening the normally closed second (solenoid) valve 33. The additive flows to the metered siphon injector 32 adjacent the first conduit 14. The second switch 24 is preferably closed for the second valve 33 to actuate. When the flow is obstructed by the shutoff valve 46 or other interruptions, the second valve 46 closes and stops the flow of the additive into the first conduit 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A safety shutoff system for a steam cleaning device, comprising:

a fluid reservoir for holding a volume of fluid;

a first valve;

a first conduit fluidly connecting said fluid reservoir to said first valve;

said first conduit having a first pump for pumping fluid through said first conduit from said fluid reservoir towards said first valve;

a by-pass conduit fluidly connecting said first valve to said fluid reservoir;

an outlet conduit being fluidly connected to said first valve;

said first valve permitting selective passage of fluid from said first conduit into said outlet conduit when open, said first valve closing passage of fluid from said first conduit into said outlet conduit when said first valve detects a pressure in said outlet conduit greater than a predetermined pressure such that fluid flowing from said first conduit passes into said by-pass conduit;

said outlet conduit having an open end, said outlet conduit having a spray gun at said open end of said outlet conduit;

said spray gun having a shutoff valve, said shutoff valve being for selective opening and closing of said outlet conduit;

said outlet conduit having a heater for heating fluid passing through said outlet conduit, said heater being positioned between said first valve and said shutoff valve;

said outlet conduit having a first switch being located between said first valve and said heater, said first switch being operatively connected to said heater, said first switch detecting the rate of fluid flow through said outlet conduit, said first switch being for selectively activating said heater to provide heat, said first switch triggering deactivation of said heater when the rate of fluid flow through said outlet conduit between said first valve and said heater is less than a predetermined rate of fluid flow; and said outlet conduit having a second switch, said second switch being located between said heater and said shutoff valve, said second switch being operatively connected to said heater, said second switch detecting the temperature of fluid in said outlet conduit between said heater and said shutoff valve, said second switch triggering deactivation of said heater when the temperature of the fluid in said outlet conduit between said heater and said shutoff valve is greater than a predetermined temperature.

2. The safety shutoff system of claim 1, wherein said first valve comprises an unloader valve.

3. The safety shutoff system of claim 1, further comprising a second conduit fluidly connecting said fluid reservoir to said first valve, wherein said second conduit has a second pump for pumping fluid through said second conduit from said fluid reservoir towards said first valve, wherein said first valve permits selective passage of fluid from said first and second conduits into said outlet conduit when open, said first valve closing passage of fluid from said first and second conduits into said outlet conduit when said first valve detects a pressure in said outlet conduit greater than a predetermined pressure such that fluid flowing from said first and second conduits passes into said by-pass conduit.

4. The safety shutoff system of claim 1, further comprising an additive reservoir for holding an additive, said additive reservoir being in fluid communication with said first conduit between said fluid reservoir and said first valve; and an additive delivery system for introducing an additive from said additive reservoir into said first conduit between said fluid reservoir and said first valve.

5. The safety shutoff system of claim 4, wherein said additive reservoir being in fluid communication with said first conduit between said fluid reservoir and said first pump.

6. The safety shutoff system of claim 5, wherein said additive delivery system comprises a siphon injector and a second valve, said second valve being interposed between said siphon injector and said additive reservoir.

7. The safety shutoff system of claim 6, wherein said second valve comprises a solenoid valve.

8. The safety shutoff system of claim 6, wherein said second valve of said additive delivery system is operatively connected to said first switch such that said first switch triggers closure of said second valve when said first switch triggers deactivation of said heater.

9. The safety shutoff system of claim 1, wherein said outlet conduit includes a length of flexible hose being located adjacent said spray gun.

10. The safety shutoff system of claim 1, wherein said outlet conduit has a third valve being located between said heater and said shutoff valve, said third valve reducing pressure in said outlet conduit when pressure in said outlet valve is greater than a predetermined pressure.

11. The safety shutoff system of claim 10, wherein said third valve comprises a pressure relief valve.

12. The safety shutoff system of claim 1, wherein said outlet conduit has a third switch being located between said first valve and said heater, said third switch being for cutting off power from a power supply supplying power to the steam cleaning device when pressure in said outlet conduit is greater than a predetermined pressure.

13. The safety shutoff system of claim 1, wherein said third switch comprises a pressure switch.

14. A safety shutoff system for a steam cleaning device, comprising:

a fluid reservoir for holding a volume of fluid;

a first valve, wherein said first valve comprises an unloader valve;

a first conduit fluidly connecting said fluid reservoir to said first valve;

said first conduit having a first pump for pumping fluid through said first conduit from said fluid reservoir towards said first valve;

a second conduit fluidly connecting said fluid reservoir to said first valve;

said second conduit having a second pump for pumping fluid through said second conduit from said fluid reservoir towards said first valve;

a by-pass conduit fluidly connecting said first valve to said fluid reservoir;

an additive reservoir for holding an additive, said additive reservoir being in fluid communication with said first conduit between said fluid reservoir and said first pump;

an additive delivery system for introducing an additive from said additive reservoir into said first conduit between said fluid reservoir and said first pump, wherein said additive delivery system comprising a siphon injector and a second valve, wherein said second valve comprises a solenoid valve, said second valve being interposed between said siphon injector and said additive reservoir;

an outlet conduit being fluidly connected to said first valve;

said first valve permitting selective passage of fluid from said first and second conduits into said outlet conduit when open, said first valve closing passage of fluid from said first and second conduits into said outlet conduit when said first valve detects a pressure in said outlet conduit greater than a predetermined pressure such that fluid flowing from said first and second conduits passes into said by-pass conduit;

said outlet conduit having an open end, said outlet conduit having a spray gun at said open end of said outlet conduit;

said outlet conduit including a length of flexible hose being located adjacent said spray gun;

said spray gun having a shutoff valve, said shutoff valve being for permitting selective opening and closing of said outlet conduit, said shutoff valve having an actuator for permitting a user to selectively open and close said shutoff valve;

said outlet conduit having a heater for heating fluid passing through said outlet conduit, said heater being positioned between said first valve and said length of flexible hose;

said outlet conduit having a first switch being located between said first valve and said heater, said first switch being operatively connected to said heater, said first switch detecting the rate of fluid flow through said outlet conduit, said first switch being for selectively activating said heater to provide heat, said first switch triggering deactivation of said heater when the rate of fluid flow through said outlet conduit between said first valve and said heater is less than a predetermined rate of fluid flow;

said second valve of said additive delivery system being operatively connected to said first switch such that said first switch triggers closure of said second valve when said first switch triggers deactivation of said heater;

said outlet conduit having a second switch, said second switch being located between said heater and said shutoff valve, said second switch being operatively connected to said heater, said second switch detecting the temperature of fluid in said outlet conduit between said heater and said shutoff valve, said second switch triggering deactivation of said heater when the temperature of the fluid in said outlet conduit between said heater and said shutoff valve is greater than a predetermined temperature;

said outlet conduit having a third valve being located between said heater and said shutoff valve, wherein said third valve comprises a pressure relief valve, said third valve reducing pressure in said outlet conduit when pressure in said outlet valve is greater than a predetermined pressure; and said outlet conduit having a third switch being located between said first valve and said heater, wherein said third switch comprises a pressure switch, said third switch being for cutting off power from a power supply supplying power to the steam cleaning device when pressure in said outlet conduit is greater than a predetermined pressure.

* * * * *